US008662634B2

(12) United States Patent
Katoh

(10) Patent No.: US 8,662,634 B2
(45) Date of Patent: Mar. 4, 2014

(54) IMAGE FORMING APPARATUS INCLUDING LIQUID EJECTION HEAD FOR EJECTING LIQUID DROPLETS

(71) Applicant: Tomomi Katoh, Kanagawa (JP)

(72) Inventor: Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/775,832

(22) Filed: Feb. 25, 2013

(65) Prior Publication Data

US 2013/0241994 A1 Sep. 19, 2013

(30) Foreign Application Priority Data

Mar. 13, 2012 (JP) ..... 2012-055456

(51) Int. Cl.
*B41J 2/165* (2006.01)

(52) U.S. Cl.
USPC ..... 347/30; 347/84; 347/92

(58) Field of Classification Search
USPC ..... 347/29, 30, 34, 36, 84–86, 89, 90, 347/92–93
See application file for complete search history.

(56) References Cited

U.S. PATENT DOCUMENTS 6,460,984 B1 * 10/2002 Matsumoto et al. ..... 347/86
2005/0116997 A1 6/2005 Katoh et al.
2009/0290002 A1 11/2009 Katoh
2010/0214378 A1 8/2010 Katoh et al.
2011/0050816 A1 3/2011 Katoh et al.
2011/0134184 A1 6/2011 Katoh et al.
2011/0141167 A1 6/2011 Kikkawa et al.
2011/0164078 A1 7/2011 Katoh et al.
2011/0216111 A1 9/2011 Katoh
2012/0044284 A1 2/2012 Katoh
2012/0236094 A1 9/2012 Katoh

FOREIGN PATENT DOCUMENTS

JP 2003-237108 8/2003
JP 2005-119031 5/2005
JP 2009-023108 2/2009
JP 2009-095981 5/2009
JP 2009-143244 7/2009
JP 2011-116089 6/2011

* cited by examiner

*Primary Examiner* — Thinh Nguyen
(74) *Attorney, Agent, or Firm* — Cooper & Dunham LLP

(57) ABSTRACT

An image forming apparatus includes a liquid ejection head, a head tank, a liquid storage container, a liquid supply passage, a liquid feed device, a control valve, and a suction device. The control valve is disposed at the liquid supply passage to open and close the liquid supply passage between the head tank and the liquid storage container. The head tank has a filter, a flow channel, a deformable wall face member, and a gap maintaining elastic member. The wall face member is opposed to the filter and forms a wall face of the channel. The elastic member is disposed in the head tank to urge the wall face member in a direction to increase a gap between the wall face member and the filter. When the suction device sucks liquid from the nozzles with the valve closed, the wall face member deforms in a direction to approach the filter.

7 Claims, 6 Drawing Sheets

IMAGE FORMING APPARATUS INCLUDING LIQUID EJECTION HEAD FOR EJECTING LIQUID DROPLETS

CROSS-REFERENCE TO RELATED APPLICATIONS

This patent application is based on and claims priority pursuant to 35 U.S.C. §119 to Japanese Patent Application No. 2012-055456, filed on Mar. 13, 2012, in the Japan Patent Office, the entire disclosure of which is hereby incorporated by reference herein.

BACKGROUND

1. Technical Field

This disclosure relates to an image forming apparatus, and more specifically to an image forming apparatus including a liquid ejection head for ejecting liquid droplets.

2. Description of the Related Art

Image forming apparatuses are used as printers, facsimile machines, copiers, plotters, or multi-functional devices having two or more of the foregoing capabilities. As one type of image forming apparatuses employing a liquid-ejection recording method, inkjet recording apparatuses are known that use a recording head for ejecting droplets of ink.

Several different types of liquid ejection heads are known as recording heads usable in such liquid-ejection-type image forming apparatuses. One example is a piezoelectric head that ejects droplets by deforming a diaphragm using, e.g., piezoelectric actuators. When the piezoelectric actuators deform the diaphragm, the volumes of chambers containing the liquid change, thus increasing the internal pressures of the chambers to eject droplets from the head. Another example is a thermal head that ejects droplets by increasing the internal pressures of chambers with, e.g., heaters disposed in the chambers. The heaters are heated by electric current to generate bubbles in the chambers. As a result, the internal pressures of the chambers increase, thus ejecting droplets from the head.

For such liquid-ejection type image forming apparatuses, there is demand for enhancing throughput, i.e., speed of image formation. One way to increase the throughput is to enhance the efficiency of liquid supply. For example, a tube supply method is proposed to supply ink from a large-volume ink cartridge (main tank) mounted in an image forming apparatus to a head tank (also referred to as a sub tank or buffer tank) mounted in an upper portion of the recording head through a tube.

Such a tube supply method can reduce the weight and size of a carriage unit mounting the recording (liquid ejection) head and the head tank, thus reducing the size of the image funning apparatus including a structural system and a driving system.

However, for example, an increase in the number of nozzles of the head, an increase in the flow amount of ink feeding associated with use of higher frequencies in driving the head, and an increase in the viscosity of ink to reduce drying time may be advanced to further enhance printing throughput. As a result, a pressure loss due to a fluid resistance of a tube against a flow of ink may cause an ink supply shortage. In particular, an image forming apparatus capable of recording images on large-size print media may have a long tube, thus causing a large pressure loss.

Hence, for example, JP-4572987-B1 (JP-2009-143244-A) proposes to provide a pressure-difference regulation valve at an upstream side from a recording head in an ink supply direction to supply ink to the recording head only when a negative pressure in the head tank is greater than a predetermined pressure value. Such a configuration allows pressurization of ink in a supply tube to cancel a pressure loss in the supply tube.

In a liquid-ejection-type image forming apparatus, a filter may be disposed at a recording head to filter ink to be supplied to the recording head, which may cause a failure in bubble discharge.

For example, air may intrude into an ink supply channel due to a variety of causes, such as introduction of air on installation and removal of an ink cartridge or permeability of components of the ink supply channel. Such air intruding into the head may cause failures, such as ejection failure. Here, for air intruding from an upstream side of the ink supply channel, the filter near the head prevents such air from intruding into the head. As a result, such air may accumulate at an upstream side of the ink supply channel from the filter in the ink supply direction. When such air contacts a surface of the filter, ink does not flow in a contact area of air with the filter. As a result, when a certain amount of air accumulates at the upstream side of the ink supply channel, such air needs to be discharged from the recording head.

Hence, for example, JP-4572987-B1 (JP-2009-143244-A) proposes a bubble discharge method with choke cleaning. In the method, with a supply channel closed, liquid is sucked from nozzles of the recording head. After drastically reducing the pressure of a filter unit, the supply channel is opened. As a result, a high-speed ink flow arises in a filter unit, thus passing and discharging bubbles through the filter.

To perform high speed printing with highly viscous ink, it is preferable to increase the area of the filter to reduce resistance against ink flow to prevent ink supply shortage. As described above, for the bubble discharge method with choke cleaning described in JP-4572987-B1 (JP-2009-143244-A), such an increased area of the filter may cause insufficient bubble discharge performance.

BRIEF SUMMARY

In an aspect of this disclosure, there is provided an image forming apparatus including a liquid ejection head, a head tank, a liquid storage container, a liquid supply passage, a liquid feed device, a control valve, and a suction device. The liquid ejection head has nozzles to eject droplets of liquid. The head tank supplies the liquid to the liquid ejection head. The liquid storage container stores the liquid. The liquid supply passage connects the head tank to the liquid storage container. The liquid feed device feeds the liquid from the liquid storage container to the head tank via the liquid supply passage. The control valve is disposed at the liquid supply passage to open and close the liquid supply passage between the head tank and the liquid storage container. The suction device sucks the liquid from the nozzles. The head tank has a filter, a flow channel, a deformable wall face member, and a gap maintaining elastic member. The filter filters the liquid. The flow channel supplies the liquid to the liquid ejection head. The deformable wall face member is opposed to the filter and forms a wall face of the now channel. The gap maintaining elastic member is disposed in the head tank to urge the wall face member in a direction to increase a gap between the wall face member and the filter. When the suction device sucks the liquid from the nozzles with the control valve closed, the wall face member deforms in a direction to approach the filter.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
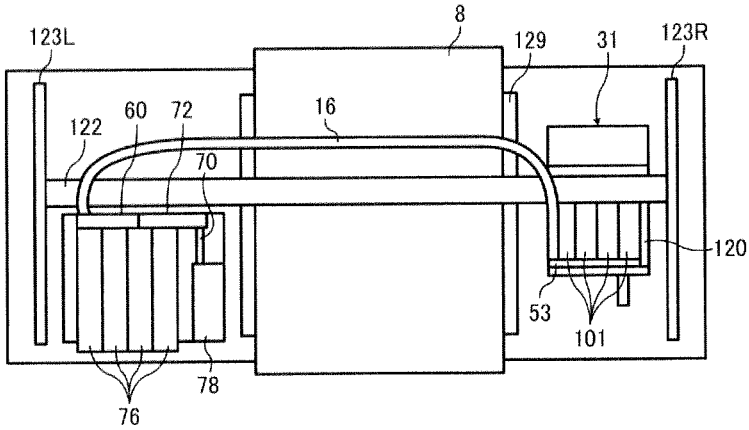
FIG. 1 is a schematic plan view of an inkjet recording apparatus serving as an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 2:
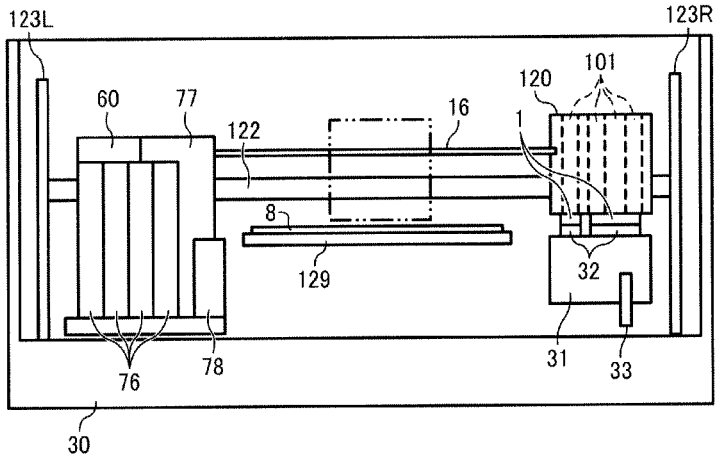
FIG. 2 is a schematic front view of the inkjet recording apparatus illustrated in FIG. 1.
Figure 3:
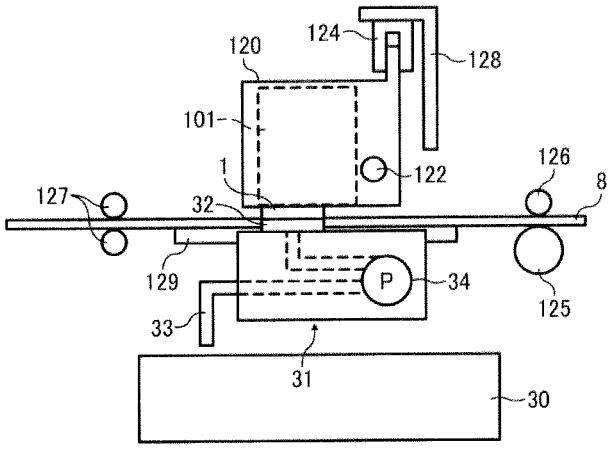
FIG. 3 is a schematic side view of the inkjet recording apparatus illustrated in FIG. 1.

First, an inkjet recording apparatus is described as an image forming apparatus according to an exemplary embodiment of this disclosure with reference to FIGS. 1 to 3.

FIG. 1 is a schematic plan view of an inkjet recording apparatus according to an exemplary embodiment of this disclosure. FIG. 2 is a schematic front view of the inkjet recording apparatus. FIG. 3 is a schematic side view of the inkjet recording apparatus.

In the inkjet recording apparatus, a carriage 120 is supported by a guide rod 122 and a guide rail 124 so as to be movable in a main scanning direction (i.e., a longitudinal direction of the guide rod 122). The guide rod 122 serving as a guide member extends between a left side plate 123L and a right side plate 123R standing on a body frame 30, and the guide rail 124 is mounted on a rear frame 128 disposed on the body frame 30. The carriage 120 is moved in the longitudinal direction of the guide rod 122 (the main scanning direction) by a main scanning motor and a timing belt.

The carriage 120 mounts recording heads 1 serving as liquid ejection heads to eject ink droplets of different colors, e.g., black (K), cyan (C), magenta (M), and yellow (Y). The recording heads (liquid ejection heads) 1 are mounted on the carriage 120 so that multiple nozzles (ink ejection ports) 5 are arranged in rows in a direction perpendicular to the main scanning direction and ink droplets are ejected downward from the nozzles 5.

Figure 4:
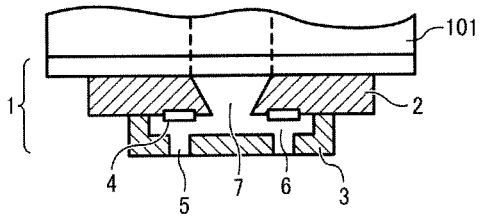
FIG. 4 is a partially enlarged view of a recording head of the inkjet recording apparatus illustrated in FIG. 1 according to an exemplary embodiment.

As illustrated in FIG. 4, the recording head 1 includes a heater substrate 2 and a chamber formation member 3 and ejects, as droplets, ink sequentially supplied to a common channel 7 and liquid chambers (individual channels) 6 through an ink channel formed in the heater substrate 2. As illustrated in FIG. 4, the recording head 1 may be, for example, a thermal-type head that obtains pressure for ejecting ink by film boiling of ink generated by heaters 4 and a side-shooter-type head in which a direction in which ink flows toward each ejection-energy acting part (heater part) within each liquid chamber 6 is perpendicular to a central axis of an opening of each of the nozzles 5.

It is to be noted that the recording head 1 is not limited to the above-described thermal type head but may be a piezoelectric-type head that obtains ejection pressure by deforming a diaphragm with piezoelectric elements, an electrostatic-type head that obtains ejection pressure by deforming a diaphragm with electrostatic force, or any other suitable type head.

Below the carriage 120, a sheet 8 on which an image is formed by the recording heads 1 is conveyed in a direction (hereinafter "sub-scanning direction") perpendicular to the main scanning direction. As illustrated in FIG. 3, the sheet 8 is sandwiched between a conveyance roller 125 and a pressing roller 126 and conveyed to an image formation area (printing area) of the recording heads 1. The sheet 8 is further conveyed onto a print guide member 129 and fed by a pair of output rollers 127 in a sheet output direction.

At this time, scanning of the carriage 120 in the main scanning direction is properly synchronized with ejection of ink droplets from the recording heads 1 in accordance with image data to form a first band of a desired image on the sheet 8. After the first band of the image has been formed, the sheet 8 is fed by a certain distance in the sub-scanning direction and the recording heads 1 form a second band of the desired image on the sheet 8. By repeating such operations, the whole image is formed on the sheet 8.

Head tanks (also referred to as buffer tanks or sub tanks) 101 including ink chambers 104 to temporarily store ink are integrally connected to upper portions of the recording heads 1. The term "integrally" as used herein represents that the recording heads 1 are connected to the head tank 101 via, e.g., tubes or pipes and both the recording heads 1 and the head tanks 101 are mounted on the carriage 120.

Desired color inks are supplied from ink cartridges 76 serving as liquid storage containers (main tanks) that separately store the respective color inks, to the head tanks 101 via liquid supply tubes 16 (ink supply tubes) serving as a liquid supply passage. The ink cartridges (main tanks) 76 are detachably mounted on, e.g., a cartridge holder disposed at one end of the inkjet recording apparatus in the main scanning direction.

At an opposite end of the inkjet recording apparatus in the main scanning direction is disposed a maintenance and recovery device 31 (hereinafter, maintenance device 31) that maintains and recovers conditions of the recording heads 1. The maintenance device 31 has caps 32 to cap nozzle faces of the recording heads 1 and a suction pump 34 serving as a liquid suction device to suck interior of the caps 32, and a drain passage 33 to drain waste liquid (waste ink) sucked by the suction pump 34. The waste ink is discharged from the drain passage 33 to a waste liquid tank mounted on the body frame 30. The maintenance device 31 also has a moving mechanism to reciprocally move the caps 32 back and forth (in this embodiment, up and down) relative to the nozzle faces of the recording heads 1. The maintenance device 31 further has a wiping member to wipe the nozzle faces of the recording heads 1 and a wiping unit to hold the wiping member so that the wiping member is reciprocally movable back and forth relative to the nozzle faces of the recording heads 1.

Next, a head tank according to a first exemplary embodiment is described with reference to FIGS. 5, 6A, 6B, 7A, 7B, and 7C.

Figure 5:
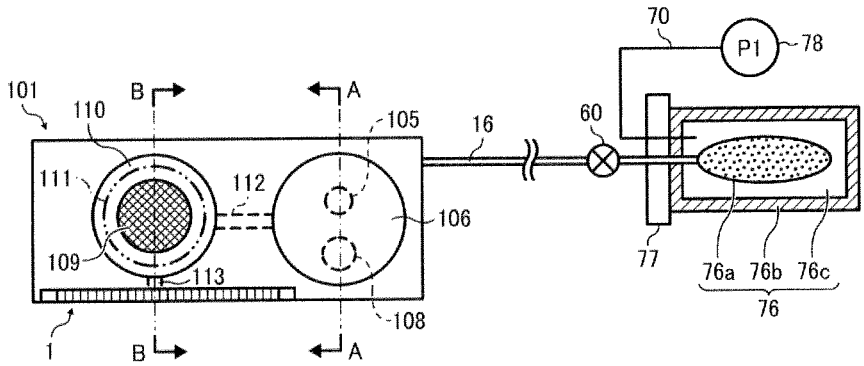
FIG. 5 is a schematic illustration of a head tank and a supply system to supply ink to the head tank according to a first exemplary embodiment.
Figure 6A:
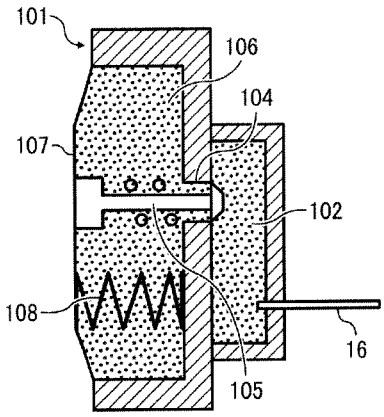
FIGS. 6A and 6B are cross-sectional views of the head tank cut along a line A-A of FIG. 5.
Figure 6B:
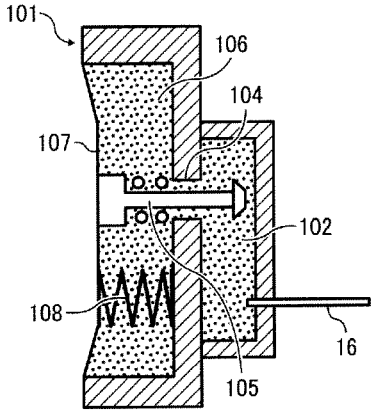
Figure 7A:
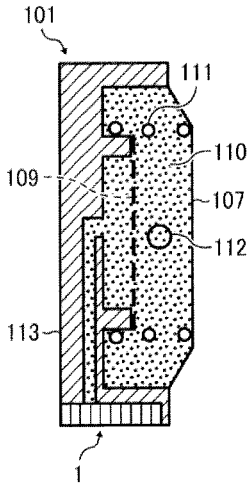
FIGS. 7A to 7C are cross-sectional views of the head tank cut along a line B-B of FIG. 5.
Figure 7B:
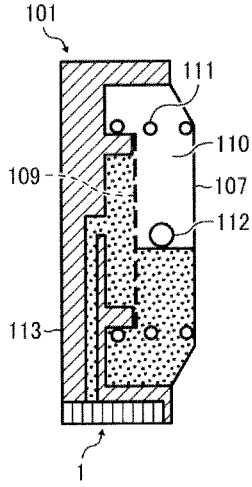
Figure 7C:
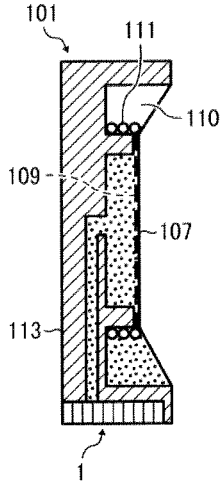

FIG. 5 is a front view of a head tank 101 and an ink supply system in the first exemplary embodiment. FIGS. 6A and 6B are cross-sectional views of the head tank 101 cut along a line A-A illustrated in FIG. 5. FIGS. 7A to 7C are cross-sectional views of the head tank 101 cut along a line B-B illustrated in FIG. 5. In FIGS. 5 to 7C, components may be omitted or cross sections thereof may be partially shown for clarity.

As illustrated in FIGS. 6A and 6B, the head tank 101 has an ink chamber 106, a pressurizing chamber 102, and a passage 104 disposed between the ink chamber 106 and the pressurizing chamber 102.

A liquid supply tube 16 is connected to the pressurizing chamber 102. For the ink supply system in this exemplary embodiment, when printing or bubble discharging is performed, ink in the pressurizing chamber 102 is pressurized.

The head tank 101 has a deformable film member 107 at a wall face thereof. The film member 107 serving as a deformable wall face member is urged by a spring 108 in a direction to increase the volume of the head tank 101. Thus, as illustrated in FIG. 6A, the film member 107 is inflated in a convex shape toward the outside of the head tank 101.

A negative-pressure conjunction valve 105 serving as a supply valve is disposed adjacent to the film member 107. The negative-pressure conjunction valve 105 is a valve to control a communication state and a non-communication state between the ink chamber 106 and the pressurizing chamber 102 (i.e., open and close the passage 104).

As illustrated in FIG. 6A, the negative-pressure conjunction valve 105 normally retains a closed state between the ink chamber 106 and the pressurizing chamber 102. However, when ink in the ink chamber 106 is consumed, the film member 107 deforms toward an interior of the ink chamber 106 as illustrated in FIG. 6B. As a result, the negative-pressure conjunction valve 105 is opened to communicate the ink chamber 106 with pressurizing chamber 102.

A filter chamber 110 serving as a flow channel of the head tank 101 is disposed between the ink chamber 106 and the recording head 1. The filter chamber 110 includes a filter 109 to filter ink to remove foreign substance, and supplies the filtered ink to a recording head 1.

As illustrated in FIG. 7A, the film member 7 serving as a deformable wall face member also forms a wall face of the filter chamber 110 like the ink chamber 106.

Around the filter 109 is disposed a gap maintaining spring 111, e.g., a compression spring serving as a gap-maintaining elastic member. The gap maintaining spring 111 urges the film member 107 in a direction to move away from the filter 109.

In normal printing or nozzle recovery operation except for when suction in choke cleaning described below is performed, the gap maintaining spring 111 generates a restoring force to maintain a gap between the film member 107 and the filter 109. By contrast, during suction of choke cleaning, suction pressure overcomes the restoring force of the gap maintaining spring 111, thus closely contacting the film member 107 with the filter 109.

In another exemplary embodiment, when the restoring force of the gap maintaining spring 111 is overcome by suction pressure during suction of choke cleaning, the film member 107 may deform in a direction to approach to the filter 109, for example, to a position adjacent to the filter 109 without contacting the filter 109.

Next, the entire ink supply system in this exemplary embodiment is described with reference to FIGS. 1, 2, 3, and 5.

As illustrated in FIG. 5, the ink cartridge 76 to store ink to be supplied to the recording head 1 includes an ink bag 76*a* to store ink and a case member 76*b* to accommodate the ink bag 76*a* in a closed state. An air layer 76*c* is formed in a closed space between the ink bag 76*a* and the case member 76*b*.

The ink cartridge 76 is mounted on a cartridge holder 77. When the ink cartridge 76 is mounted on the cartridge holder 77, as illustrated in FIG. 5, the ink bag 76*a* of the ink cartridge 76 is communicated with the liquid supply tube 16, and the air layer 76*c* is communicated with an air supply tube 70.

The air supply tube 70 is connected to a pressurizing pump 78 (P1) serving as a liquid feed device. The pressurizing pump 78 feeds air into and out from the air layer 76*c* of the ink cartridge 76, thus allowing pressurizing of the ink bag 76*a*.

The ink bag 76*a* is connected to the pressurizing chamber 106 of the head tank 101 via the liquid supply tube 16. By driving the pressurizing pump 78, the pressure of ink in the pressurizing chamber 102 is controlled.

The liquid supply tube 16 has a control valve 60 to open and close the liquid supply tube 16 between the ink cartridge 76 and the head tank 101.

In normal printing, the control valve 60 is open and the pressurizing pump 78 is en to maintain the pressurizing chamber 102 within a proper range of pressure. In non printing periods, as described above, the negative-pressure conjunction valve 105 closes the passage 104 (as illustrated in FIG. 6A). As a result, a negative pressure in the ink chamber 106 is maintained by the spring 108.

When ink in the ink chamber 106 is consumed by printing, the negative pressure in the ink chamber 106 rises. However, before the negative pressure rises to a value at which ink cannot be ejected from the recording head 1, as illustrated in FIG. 6B, the negative-pressure conjunction valve 105 is opened, thus replenishing ink from the pressurizing chamber 102 to the ink chamber 106.

At this time, since ink in the pressurizing chamber 102 is pressurized, ink is replenished at a speed faster than a speed at which ink in the ink chamber 106 is consumed. Such a configuration prevents replenishment shortage of ink due to an increase in the negative pressure of the ink chamber 106. As ink is replenished, the negative pressure in the ink chamber 106 gradually decreases and the volume of the ink chamber 106 increases. As a result, the head tank 101 returns to a state of FIG. 6A and the negative-pressure conjunction valve 105 closes the passage 104 again.

During printing, the head tank 101 supplies ink to the recording head 1 while alternately repeating the state of FIG. 6A and the state of FIG. 6B with consumption of ink.

For the ink supply system, ink in the liquid supply tube 16 is also pressurized. Even when highly viscous ink is consumed at a high speed, such a configuration can prevent replenishment shortage of ink due to a pressure loss of the liquid supply tube 16.

It is preferable to minimize a pressure loss at the filter 109 to eject highly viscous ink at a high speed. Hence, in this exemplary embodiment, the filter 109 has a large area to reduce a fluid resistance to a flow of ink, thus preventing replenishment shortage of ink due to the pressure loss in the filter chamber 110.

When the filter 109 has such a large area, bubbles accumulating in the filter chamber 110 over time may be unlikely to be discharged. Hence, in a manner described below, this exemplary embodiment allows bubbles to be easily discharged from the filter chamber 110 while using such a large size of the filter 109.

Below, bubble discharge from the filter chamber 110 in this exemplary embodiment is described with reference to FIGS. 7A to 7C.

As described above, at one end of the inkjet recording apparatus in the main scanning direction, the maintenance device 31 is disposed to maintain and recover the recording head 1. In recovering the recording head 1 from an ejection failure state to a normal state, the nozzle face of the recording head 1 is capped with the cap 32 with ink in an ink supply channel pressurized by driving the pressurizing pump 78. With the nozzle face capped with the cap 32, the suction pump 34 is driven to suck and discharge ink from the nozzles 5 into the cap 32 (nozzle suction). After the nozzle suction is stopped, the cap 32 is separated from the nozzle lace. Then, the wiping member wipes the nozzle face. The recording head 1 is driven to eject ink into the cap 32 or a dummy ejection receptacle (dummy ejection).

However, for such normal recovery operation, a large amount of air accumulated in the filter chamber 110 as illustrated in FIG. 7B may not pass through the filter 109, move toward the recording head 1, and exit from the nozzles 5 of the recording head 1. Hence, in such a case, the inkjet recording apparatus performs choke cleaning.

The choke cleaning is described below.

First, the pressurizing pump 78 illustrated in FIG. 5 is not driven, and the ink supply tube 16 is closed by the control valve 60 with ink in the supply channel not pressurized.

Next, after the nozzle face of the recording head 1 is capped with the cap 32, the suction pump 34 is driven to suck ink from the nozzles 5 of the recording head 1. At this time, since the control valve 60 is closed and ink is not supplied from the ink cartridge 76, a negative pressure in a flow channel between the control valve 60 and the recording head 1 sharply increases, thus causing a choked state.

At this time, as illustrated in FIG. 7C, the gap maintaining spring 111 in the filter chamber 110 is compressed by the increased negative pressure and the film member 107 closely contacts (adhere to) the filter 109.

As a result, since an internal volume of the filter chamber 110 decreases as compared to a state of FIG. 7B prior to the nozzle suction, air in the filter chamber 110 passes through the filter 109 and pushed into the recording head 1.

When the pressurizing pump 78 is driven and the control valve 60 opens, ink flows through the supply channel at a high speed. As a result, such air pushed into the recoding head 1 is discharged to the outside via the cap 32.

As described above, the filter chamber 110 includes the film member 107 facing the filter 109 and the gap maintaining spring 111 to maintain a gap between the filter 109 and the film member 107. Action of the gap maintaining spring 111 allows close contact of the film member 107 with the filter 109 only during suction of choke cleaning. Such a configuration can secure a flow channel of ink in the filter chamber 110 except for when air (bubbles) is (are) discharged from the filter chamber 110.

In such a case, if the film member 107 is formed so as to closely contact the filter 109, the filter 109 can adhere to the film member 107 without the gap maintaining spring 111 during choke suction, thus obtaining a bubble discharge performance equivalent to that of the configuration including the gap maintaining spring 111.

However, for such a configuration without the gap maintaining spring 111, when, during normal printing, a negative pressure in the recording head 1 becomes greater than that at the filter 109 by an amount corresponding to a pressure loss at the filter 109, the film member 107 is attracted to the filter 109 by a differential pressure. As a result, the film member 107 may seal the filter 109, thus causing replenishment shortage of ink.

In the above-described configuration, the filter chamber 110 includes a compression coil spring as the gap maintaining spring 111. It is to be noted that the gap maintaining spring 111 is not limited to such a compression coil spring and may be any other elastic member, such as a leaf spring or a rubber body.

In one exemplary embodiment, the gap maintaining spring 111 may be disposed outside the filter chamber 110 to draw the film member 107 from the outside of the filter chamber 110.

As described above, even in a configuration in which the film member 107 does not closely contact the filter 109, moving the film member 107 to a position adjacent to the filter 109 can create a similar bubble (air) pushing effect of the film member 107.

Next, a second exemplary embodiment of the present disclosure is described with reference to FIGS. 8A and 8B.

Figure 8A:
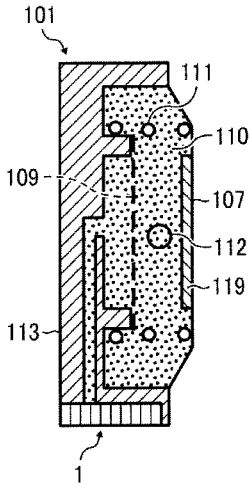
FIGS. 8A and 8B are cross-sectional views of a head tank according to a second exemplary embodiment.
Figure 8B:
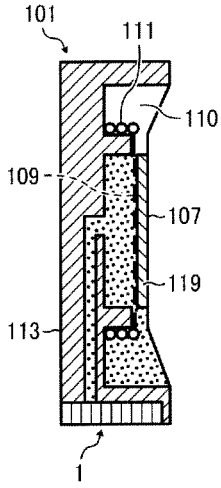

FIGS. 8A and 8B are cross-sectional views of a head tank 101 according to the second exemplary embodiment.

In this exemplary embodiment, at a film member 107 is disposed a filter choke member 119 having a face of the same shape as a shape of an opening portion of the filter 109.

The shape or thickness of the filter choke member 119 can be set in accordance with the shape of the filter 109 or a mount position of the film member 107 to obtain a desired contact state of the film member 107 with the filter 109. Thus, use of the filter choke member 119 increases the degree of freedom in design of the filter chamber 110.

In addition, in this exemplary embodiment, the film member 107 does not directly contact the filter 109 during choke suction, thus preventing damage to the film member 107 which might be caused by direct close contact of the film member 107 with the filter 109. In one embodiment, the film member 107 may be an elastic body made from, e.g., rubber, thus enhancing the degree of close contact with the filter 109.

Next, a third exemplary embodiment of the present disclosure is described with reference to FIGS. 9A and 9B.

Figure 9A:
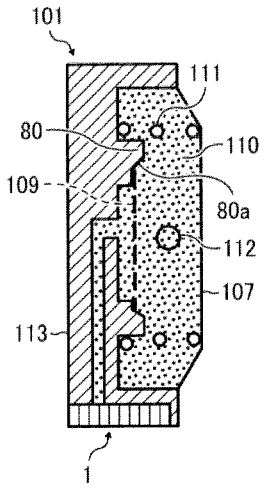
FIGS. 9A and 9B are cross-sectional views of a head tank according to a third exemplary embodiment.
Figure 9B:
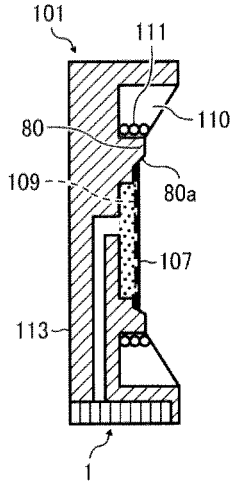

FIGS. 9A and 9B are cross-sectional views of a head tank 101 according to the third exemplary embodiment.

In this exemplary embodiment, the head tank 101 has a wall portion (convex 80 around a filter 109 that is convex toward a film member 107.

As a result, when choke suction is performed from a normal state illustrated in FIG. 9A, the film member 107 closely contacts both the filter 109 and the convex wall 80 as illustrate in FIG. 9B, thus forming a double seal state. Such a configuration enhances the degree of close contact of the film member 107 with the filter 109, thus enhancing the bubble discharge performance.

The convex wall 80 has a slant face 80*a* at an inner circumferential side thereof (proximal to the filter 109). The slant face 80*a* is smoothly slanted in a direction to approach from a top face of the convex wall 80 (proximal to the film member 107) to a surface of the filter 109.

Such a configuration can further enhance the degree of cross contact of the film member 107 with the filter 109 during choke suction.

Next, a fourth exemplary embodiment of this disclosure is described with reference to FIGS. 10, 11A, and 11B.

Figure 10:
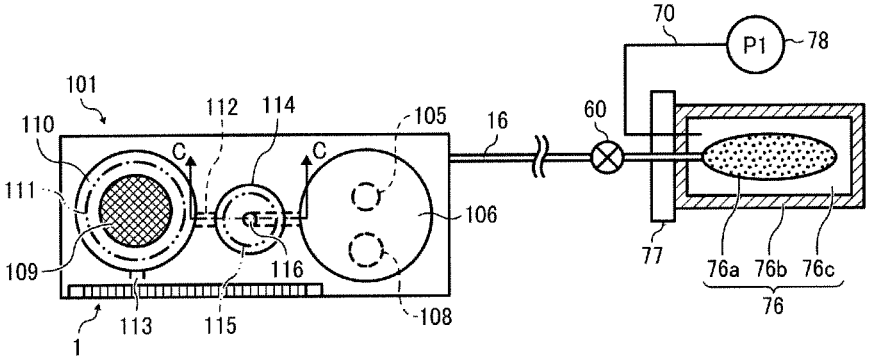
FIG. 10 is a cross-sectional view of a supply system including a head tank according to a fourth exemplary embodiment.
Figure 11A:
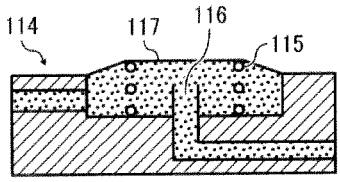
FIGS. 11A and 11B are cross-sectional views of the head tank cut along a line C-C of FIG. 10.

FIG. 10 is a cross-sectional view of a supply system including a head tank 101 according to the fourth exemplary embodiment. FIGS. 11A and 11B are cross-sectional views of the head tank 101 cut along a line C-C of FIG. 10.

In this exemplary embodiment, the head tank 101 has a check valve 114 between a filter chamber 110 and an ink chamber 106 to prevent a back flow of air from the filter chamber 110 to the ink chamber 106.

A wall face of the check valve 114 is formed with a film member 117. The film member 117 is disposed at a position opposing an opening 116 communicated with the ink chamber 106. The check valve 114 includes a spring 115 to urge the film member 117 outward (in a direction to move away from the opening 116).

Figure 11B:
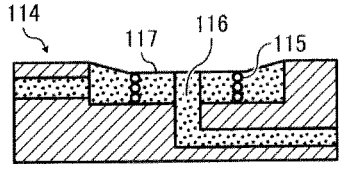

Like a gap maintaining spring 111 of FIG. 10, the spring 115 permits the film member 117 to contact the opening 116 for choking only during choke suction as illustrated in FIG. 11B.

The spring 115 has such a spring constant that, in choke suction, the spring 115 deforms earlier than the gap maintaining spring 111 and the film member 117 closes the opening 116 before the film member 107 closely contacts a filter 109.

As a result, for the head tank 101 according to this exemplary embodiment, when choke suction is performed, first, the check valve 114 at an upstream side from the filter chamber 110 in an ink supply direction closes, thus preventing air in the filter chamber 110 from moving back to the ink chamber 100. Such a configuration can more reliably pass air through the filter 109 and discharge such air from nozzles 5.

Next, a fifth exemplary embodiment of the present disclosure is described with reference to FIG. 12.

Figure 12:
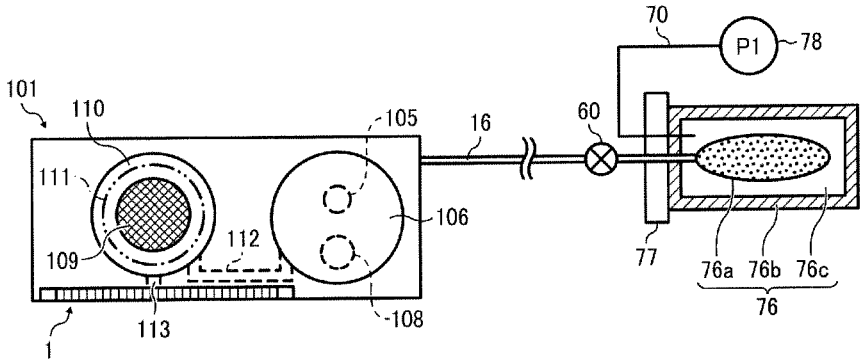
FIG. 12 is a cross-sectional view of a supply system including a head tank according to a fifth exemplary embodiment.

FIG. 12 is a cross-sectional view of a supply system including a head tank 101 according to the fourth exemplary embodiment.

This fifth exemplary embodiment can prevent a back flow of air during choke suction with a more simple configuration than the above-described fourth exemplary embodiment.

In other words, between a filter chamber 110 and an ink chamber 106, the head tank 101 according to this fifth exemplary embodiment has a passage 112 of a configuration differing from a passage 112 of the first exemplary embodiment illustrated in FIG. 5. For example, in this exemplary embodiment, the passage 112 of FIG. 12 is connected to the filter chamber 110 at a lower side in a gravitational direction.

For such a configuration, during choke suction, bubbles in the filter chamber 110 need to counter a buoyant force in order to move back to the ink chamber 106 at an upstream side in an ink supply direction. As a result, bubbles are unlikely to move back, thus enhancing the efficiency of bubble discharge.

As described above, for the ink supply system according to any of the above-described exemplary embodiments, even when the head tank 101 has the relatively large filter 109 near the recording head, the volume of the filter chamber 110 changes by choke suction. As a result, air accumulated at an upstream side from the filter 109 in the ink supply direction is discharged from the recording head 1, thus enhancing the discharge performance of bubbles.

In the above-described exemplary embodiments, the filter 109 and the negative-pressure conjunction valve 105 are included in the head tank 101. It is to be noted that, in other embodiments, such a filter and negative-pressure conjunction valve may be disposed at a desired position of the ink supply channel.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a liquid ejection head having nozzles to eject droplets of liquid;

a head tank to supply the liquid to the liquid ejection head;

a liquid storage container to store the liquid;

a liquid supply passage connecting the head tank to the liquid storage container;

a liquid feed device to feed the liquid from the liquid storage container to the head tank via the liquid supply passage;

a control valve disposed at the liquid supply passage to open and close quid supply passage between the head tank and the liquid storage container; and a suction device to suck the liquid from the nozzles, wherein the head tank comprises a filter to filter the liquid, a flow channel to supply the liquid to the liquid ejection head, a deformable wall face member opposed to the filter and forming a wall face of the flow channel, and a gap maintaining elastic member disposed in the head tank to urge the wall face member in a direction to increase a gap between the wall face member and the filter, and wherein, when the suction device sucks the liquid from the nozzles with the control valve closed, the wall face member deforms in a direction to approach the filter.

2. The image forming apparatus of claim 1, wherein the filter is disposed in the flow channel and wherein, when droplets of the liquid are ejected from the nozzles, an interior of the flow channel rums into a negative pressure.

3. The image forming apparatus of claim 1, wherein, when the suction device sucks the liquid from the nozzles with the control valve closed, the wall face member deforms until the wall face member contacts the filter.

4. The image forming apparatus of claim 3, further comprising a check valve to prevent a back flow of the liquid from the head tank to the liquid storage container, the check valve disposed at an upstream side from the filter in a supply direction of the liquid from the liquid storage container to the head tank, wherein, when the suction device sucks the liquid from the nozzles with the control valve closed, the check valve closes before the wall face member contacts the filter.

5. The image firming apparatus of claim 1, further comprising a filter choke member to seal an opening portion of the filter when the suction device sucks the liquid from the nozzles with the control valve closed.

6. The image forming apparatus of claim 1, wherein the head tank has a wall portion around the filter and the wall portion is concave toward the wall face member.

7. The image forming apparatus of claim 6, wherein the wall portion has a slant face slanted in a direction to approach a surface of the filter.

* * * * *